United States Patent [19]

Hans et al.

[11] Patent Number: 5,016,821

[45] **Date of Patent: * May 21, 1991**

[54] FUEL INJECTION VALVE

[75] Inventors: Waldemar Hans; Wilhelm Kind, both of Bamberg; Manfred Kirchner, Nuremburg; Siegfried Werner, Bamberg, all of Fed. Rep. of Germany

[73] Assignee: Robert Bosch GmbH, Stuttgart, Fed. Rep. of Germany

[ * ] Notice: The portion of the term of this patent subsequent to Mar. 13, 2007 has been disclaimed.

[21] Appl. No.: 495,601

[22] Filed: Mar. 19, 1990

Related U.S. Application Data

[62] Division of Ser. No. 272,885, Oct. 13, 1988, Pat. No. 4,934,605.

[30] Foreign Application Priority Data

Mar. 31, 1986 [DE] Fed. Rep. of Germany ..... 3710467
May 31, 1986 [DE] Fed. Rep. of Germany ..... 3618413

[51] Int. Cl.[5] ..... F02M 61/18

[52] U.S. Cl. ..... 239/585; 239/596

[58] Field of Search ..... 239/585, 596, 533.3–533.12; 251/333

[56] References Cited

U.S. PATENT DOCUMENTS

| | | | |
|---|---|---|---|
| 4,423,843 | 1/1984 | Palma | 239/585 |
| 4,621,772 | 11/1986 | Blythe et al. | 239/585 |
| 4,646,974 | 3/1987 | Sofianek et al. | 239/585 |
| 4,890,794 | 1/1990 | Imafuku et al. | 239/533 R |
| 4,903,898 | 2/1990 | Kind | 239/585 X |
| 4,907,745 | 3/1990 | Messingschlager | 239/585 X |

*Primary Examiner*—Andres Kashnikow
*Assistant Examiner*—Kevin P. Weldon
*Attorney, Agent, or Firm*—Michael J. Striker

[57] ABSTRACT

A fuel injection valve comprising a housing, a valve seat located in the housing, and a valve needle having a peg at an end thereof which peg defines with a downstream opening of a nozzle body located in the housing and forming the valve seat an annular space. A platelet is located between the nozzle body and a processing sleeve connected with the housing. The platelet has a plurality of bores extending from the annular space.

7 Claims, 3 Drawing Sheets

FUEL INJECTION VALVE

This is a division of of application Ser. No. 272,885 filed Oct. 1, 1988 now U.S. Pat. No. 4,934,605.

BACKGROUND OF THE INVENTION

The invention relates to a fuel injection valve. Known fuel injection valves operating with a valve needle as closing part have a conical sealing seat at the tip of the valve needle which opens or closes a fuel flow opening in cooperation with a likewise conical valve seat face. Such a fuel injection valve, described, for example, in German Offenlegungsschrift No. 3,502,410, has the disadvantage that during the grinding of the sealing faces of the valve needle, burrs can be produced as a result of which the sealing effect and the quality of the flow are impaired. If these burrs are subsequently removed, deformations and edge damage of the sealing seat can occur.

Other known fuel injection valves operate with spherical closing parts which are attached to the actual valve needle (German Offenlegungsschrift No. 3,318,486). Apart from an additional production step necessary in manufacturing, such valves exhibit the disadvantage that they hydraulically "stick" when being lifted away from the valve seat face and thus respond with a delay. This effect is based on a more planar contact between the closing part and the valve seat face due to the relatively large radius of the sphere. When both parts lift away from one another, a short-term underpressure is produced at the sealing seat since fuel only flows with delay into the produced free volume.

In addition, a fuel injection valve is known see (German Offenlegungsschrift No. 3,301,501), in which a perforated disc is located downstream of the valve seat in order to improve an injected fuel jet. The fuel is injected through an holes machined in this perforated disc onto the internal wall of a processing sleeve. The actual ejection end of such a fuel injection valve forms a closing collar of the processing sleeve. It is disadvantageous in this fuel injection valve that the fuel jets generated by the perforated disc impinge at a very steep angle on the internal wall of the processing sleeve. In addition, the point of impingement is far above the ejection end of the processing sleeve. The fuel "screws" itself along the internal wall of the processing sleeve to the ejection end and an ejection occurs in the form of a cone. The liquid droplets ejected during this process are relatively large which impairs the formation of an optimum fuel/air mixture.

From German Offenlegungsschrift No. 3,301,501, a peg is also known which, forming a part of the perforated disc, partially projects into the valve needle body and forms an annular conduit towards the nozzle body. However, this annular conduct is not advantageously designed with respect to flow. Coming from the valve seat, the fuel is not "guided" to the perforated disc but can be collected in various dead spaces. This extends the period of time between the lifting of a valve part away from the valve seat and the ejection of fuel from the holes, the valve operates with delay.

SUMMARY OF THE INVENTION

The object of the invention is a fuel injection valve susceptible to an easy and accurate production, with burrs and other impurities impairing the flow being prevented.

The object of the invention is achieved by forming the seated portion of the valve needle as a rounding formed by a part of an outer circumference of an imaginary orus. In addition, the smooth surface contour of the valve needle and the valve seat face produces a very good correlation between the stroke of the valve needle and the volume of the fuel flowing off. Since hydraulic sticking of the valve needle on the valve seat face is largely prevented, the fuel injection valve operates with a short opening time.

It is advantageous, in particular, also to round the transient areas arranged downstream of the sealing seat to achieve a uniform fuel flow away from the sealing seat.

Particularly good atomization of the fuel is made possible if the fuel is ejected via several holes in a thin platelet clamped between the nozzle body and a processing sleeve. This platelet can be easily and inexpensively produced and, in addition, it can be made, by deep drawing, into a shape which enables reliable centering.

It is of advantage to provide a peg reaching almost to the platelet at the valve needle. Due to the annular space formed between the peg and the nozzle body, the fuel flow is calmed and guided up to the holes without interfering dead spaces. Flow optimization is also possible by appropriate machining of the valve needle in the area between valve seat and peg, for example by using circular transient areas instead of angular ones. In practice, this leads to a reduced response time of the fuel injection valve between the lifting of the valve needle away from the valve seat and the ejection of fuel from the holes. Designing the peg as part of the valve needle and not as part of the platelet offers production advantages.

BRIEF DESCRIPTION OF THE DRAWINGS

The invention as to its construction so to its mode of operation, together with additional objects and advantages thereof, will be best understood from the following description FIG. 1 shows a cross-sectional view of the fuel injection valve according to the invention, FIG. 2 shows a partial sectional view FIG. 1 at an enlarged scale, and FIG. 3 shows, a partial sectional view showing two different embodiments of the valve needle in the area of the sealing seat.

DESCRIPTION OF THE PREFERRED EMBODIMENT

Figure 1:
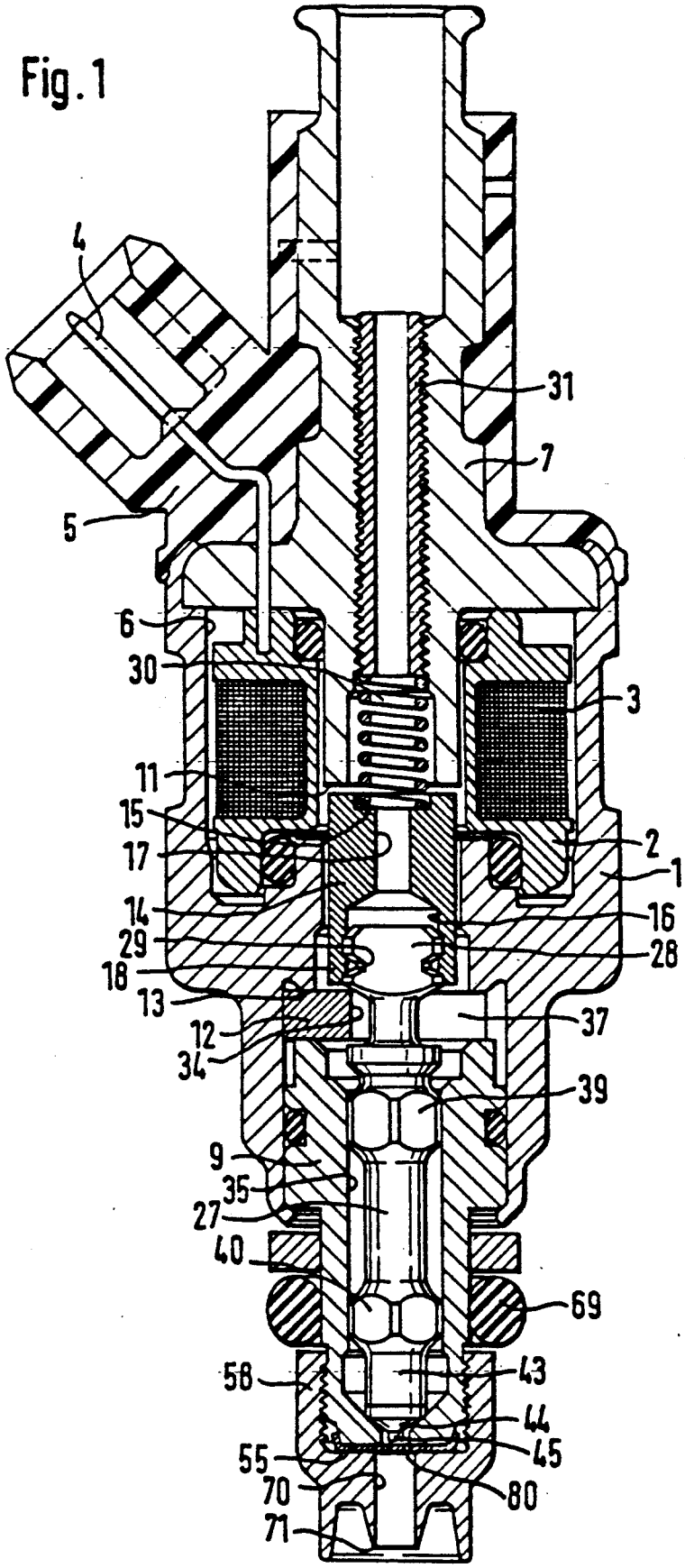
FIG. 1 illustrates a preferred embodiment of the invention.

The fuel injection valve for a fuel injection system of a mixture-compressing externally ignited internal-combustion engine shown in FIG. 1 has a valve housing 1 of ferromagnetic material in which a magnetic coil 3 is arranged on a coil support 2. The magnetic coil 3 has a current supply via a plug connection 4 which is embedded in a plastic ring 5 which partially surrounds the valve housing 1.

The coil support 2 of the magnetic coil 3 is located in a coil space 6 of the valve housing 1 on a base nipple 7 which supplies the fuel, for example gasoline, and which partially projects into the valve housing 1. The valve housing 1 partially encloses, away from the fuel nipple 7, a nozzle body 9.

Between a front face 11 of the nipple 7 and a stop plate 12 which exhibits a particular thickness for accurate adjustment of the valve and which is placed on an inner shoulder 13 of the valve housing 1, a cylindrical armature 14 is located. The armature 14 is formed of a magnetic material which is not susceptible to corrosion, and is located at a small radial distance from a magnetically conductive section of the valve housing 1, so that an annular magnetic gap is formed between armature the 14 and the magnetically conductive section, which gap is coaxial with the axis of the valve housing 1. At its two front faces, the cylindrical armature 14 is provided with first 15 and second 16 coaxial blind holes, the second blind hole 16 opening towards the nozzle body 9. The first 15 and second 16 blind holes are connected to one another by a coaxial opening 17. The diameter of the opening 17 is smaller than the diameter of the second blind hole 16. The end section of the armature 14, facing the nozzle body 9, comprises a deformed area 18. This deformation area 18 has the task of connecting, by engaging a holding body 28 which forms a part of a valve needle 27 and fills the second blind hole 16, the armature 14 to the valve needle 27 in a positively locked manner. The engaging of the holding body 28 by the deformation area 18 of the armature 14 is achieved by pressing material of the deformation area 18 into grooves 29 in the holding body 28.

A compression spring 30 rests with one end against the bottom of the first coaxial blind hole 15 and, on the other hand, rests against a tube insert 31 attached by screwing or wedging to the base nipple 7 and which insert tends to load the armature 14 and the valve needle 27 with a force acting away from the base nipple 7.

The valve needle 27 extends with a radial clearance through a hole 34 in the stop plate 12 and is guided in a guide hole 35 of the nozzle body 9. In the stop plate 12, a recess 37 is provided which leads from the through hole 34 to the circumference of the stop plate 12 and the clear width of which is greater than the diameter of the valve needle 27 in its portion which is surrounded by the stop plate 12.

The valve needle 27 has two guide sections 39 and 40 which guide the valve needle 27 in the guide hole 35, and leave an axial passage free for the fuel, and are constructed, for example, as squares.

The second guide section 40 located downstream is followed by a cylindrical section 43 of a smaller diameter. The cylindrical section 43, in turn, is followed by a tapering conical section 44 which ends in a coaxial, preferably cylindrical peg 45.

Figure 2:
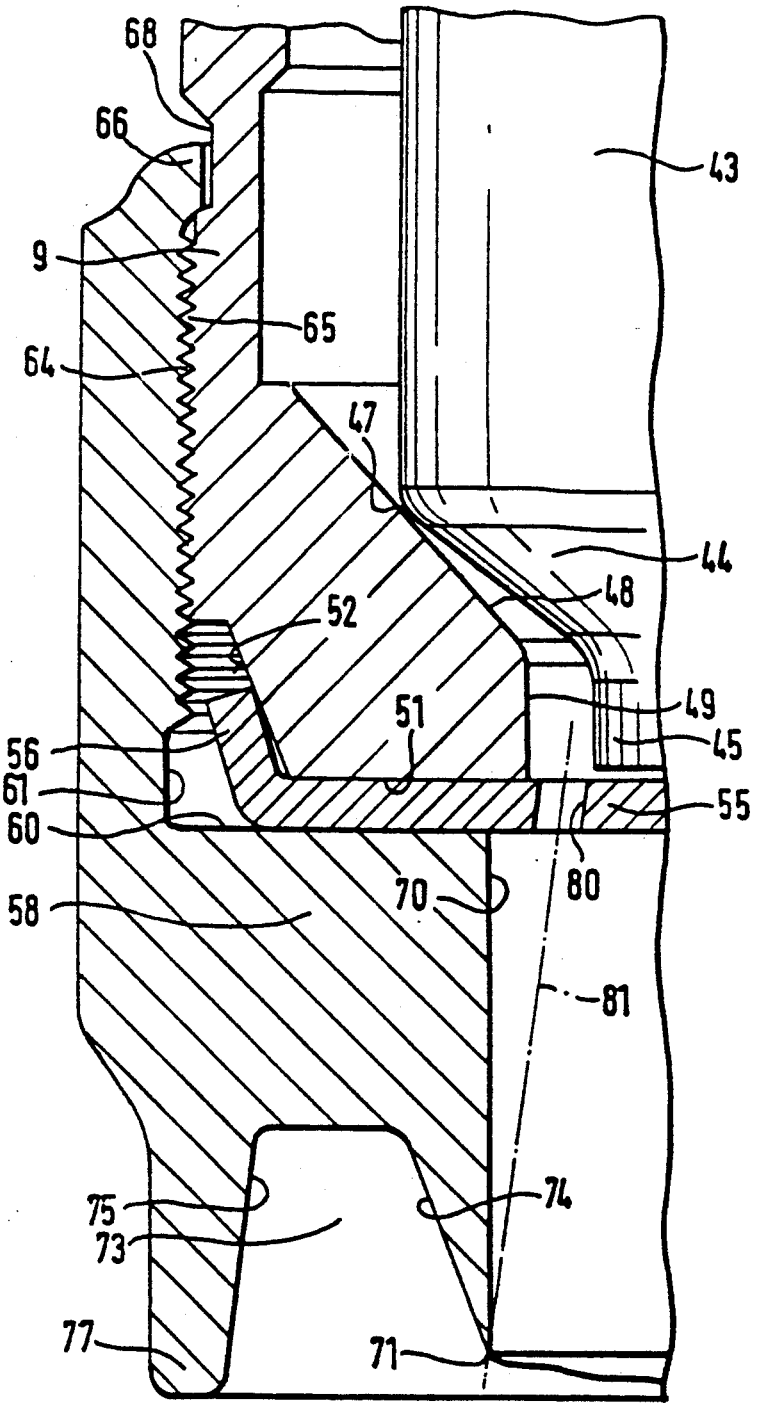
FIG. 2 is an enlargement of the nozzle body illustrated in FIG. 1.

In FIG. 2, showing a portion of FIG. 1, it can be seen that the transient area between the cylindrical section 43 and the conical section 44 is rounded—for example in the form of a radius—and forms a sealing seat 47 which, in cooperation with a conical valve seat face 48 machined in the nozzle body provides for opening and closing, respectively, of the fuel injection valve. The conical valve seat face 48 of the nozzle body 9 extends, in the direction facing away from the armature 14, into a cylindrical nozzle body opening 49 which has approximately the same length as the length of the peg 45 so that an annual gap of constant cross-section remains between the cylindrical nozzle body opening 49 and the cylindrical peg 45. The transient areas between the conical valve seat face 48, on one hand, and the cylindrical nozzle body opening 49, on the other hand, and the conical section 44 of the valve needle 27, on one hand, and the peg 45, on the other hand, are rounded in order to ensure a good flow pattern. The end surface of the nozzle body 9 in the direction facing away from the armature 14 is formed by a flat side 51 which is interrupted by the opening of the nozzle body opening 49.

The length of the peg 45 is dimensioned in such a manner that, when the fuel injection valve is closed, the peg 45 projects from the nozzle body opening 49 only slightly, that is the peg 45 ends immediately in front of the plane defined by the flat side 51 of the nozzle body 9.

While the flat side 51 of the nozzle body 9 is limited on the inside by the nozzle body opening 49, it can be limited on the outside by a conical area 52 which expands in the direction facing the armature 14.

Against the flat side 51 of the nozzle body 9, rests a platelet 55 which has a raised edge 56 which approximately follows the contour of the conical area 52 of the nozzle body 9. The edge 56 at the platelet 55 can be produced, for example, by deep drawing of the platelet 55. The attachment of the platelet 55 against the flat side 51 is ensured by a processing sleeve 58. The platelet 55 is pressed against the flat side 51 by a bottom 60 of a coaxial blind hole 61 of the processing sleeve 58 enclosing the platelet 55 in its outer area. Thus, the platelet 55 is clamped between the bottom 60 of the blind hole 61 of the processing sleeve 58 and the flat side 51 of the nozzle body 9. In this arrangement, the platelet 55 is centred by the edge 56 of the platelet 55 resting against the conical area 52 of the nozzle body 9 and the platelet 55 thus has no further radial play. Particularly good centring of the platelet 55 can be achieved if the edge 56 of the platelet 55 expands when being pushed onto the conical area 52, that is to say radial clamping is performed.

The platelet 55 is clamped between nozzle body 9 and processing sleeve 58 by the processing sleeve 58 being screwed with an internal thread 64 onto an external thread 65 machined on the circumference of the nozzle body 9. To secure the position of the processing sleeve 58 relative to the nozzle body 9 after completed screwing together, the processing sleeve 58 can be wedged in an external slot 68 of the nozzle body 9 by means of a wedging nose 66. The edge of the processing sleeve 58 facing the armature 14 is used as wedging nose 66. For the purpose of wedging, the former is bent inwards into the external slot 68 of the nozzle body 9. Between the edge forming the wedging nose 66 and the bottom 60 of the processing sleeve 58, the surface area of the blind hole 61 extends and is formed almost along its entire length by the internal thread 64. Internal thread 64 and external thread 65 are preferably formed as fine-pitched thread. The processing sleeve 58 can be used at the same time for axially securing a sealing ring 69 which radially encloses the nozzle body 9 as shown in FIG. 1.

A processing hole 70 of preferably cylindrical cross-section opens coaxially in the bottom 60 of the processing sleeve 58 and, on the other hand, opens in a sharp processing edge 71. The processing edge 71 is surrounded by an annular groove 73. In the exemplary embodiment shown, the cross section of the annular groove 73 is approximately trapezoidal, that is to say both an inner wall 74 of the annular groove 73 and an outer wall 75 of the annular groove 73 are inclined. The processing edge 71 is formed by the acute angle between the inclined inner wall 74 of the annular groove 73 and the processing hole 70. This angle should be between 10° and 20°. The outer wall 75 of the annular groove 73 forms, at the same time, the inner face of a collar 77. The collar 77 represents the part of the fuel injection valve which farthest protrudes in the direction facing away from the armature 14. The collar 77 encloses the processing edge 71 and, at the same time, projects beyond it. The collar 77 has the task of protecting the processing edge 71, which is stepped back, against damage, for example during assembly of the fuel injection valve at an internal-combustion engine.

The platelet 55 contains several holes 80 which lead from upstream to downstream of the platelet 55. Upstream of the platelet 55, the holes 80 open in the annular space formed between nozzle body opening 49 and peg 45. The centre axes 81 of the holes 80 directly point towards the processing edge 71 or barely upstream of this edge. With respect to the longitudinal axis of the fuel injection valve, the centre axis 81 of the holes 80 exhibits both a radial and a tangential component. It is very important that the angle formed between the centre axes 81 of the holes 80 and the surface area of the processing hole 70 is very shallow, that is to say that the fuel jets emerging from the holes 80 impinge at a very shallow angle on the processing hole 70. This angle of impingement should be less than 10°.

Figure 3:
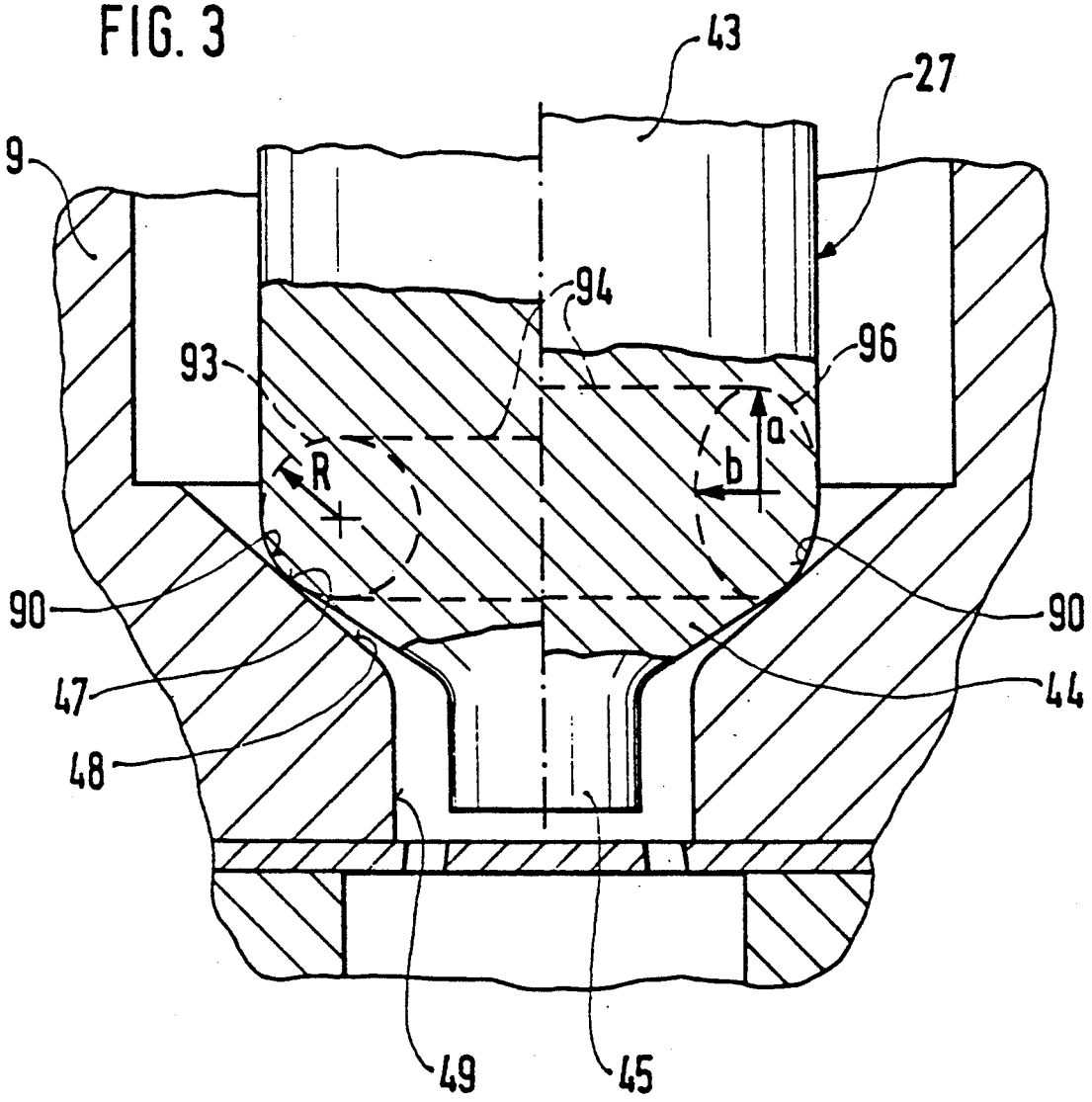
FIG. 3 illustrates in detail the contacting surfaces of the valve seat and valve steam.

The shape of the valve needle 27 in the area of the sealing seat 47 is represented in FIG. 3. The part of the valve needle 27 effecting, together with the conical valve seat face 48, the opening and closing of the injection valve is designed as rounding 90 which forms a continuous transitional surface from the cylindrical section 43 of the valve needle 27 to the conical section 44. Both the transition from the cylindrical section 43 to the rounding 90 and the transition from the rounding 90 to the conical section 44 is preferably tangential in the direction of the flow.

The contour of the rounding 90 can be formed by a radius R as shown in the left-hand semisection of FIG. 3. Imagining the radius R describing the rounding 90 to be extended into a circle 93 (shown by the dashed line), all circles 93 forming the sealing seat 47 together represent a toroid 94.

The right-hand semisection of FIG. 3 shows a second of the needle. In this arrangement, the rounding 90 follows the contour of an imagined ellipse 96. In the embodiment shown, the arrangement of the ellipse 96 is selected in such a manner that the longer one of two ellipse radii a, b extends in the axial direction of the injection valve. However, this should not be considered as a restriction; another arbitrary position of the contour of the ellipse 96 relative to the longitudinal valve axis is also possible.

The rounding 90 can also follow an arbitrary different contour which cannot be described by a radius R or by radii a, b but overall forms a toroid.

The rounding 90 is preferably produced by appropriately grinding the valve needle 27 rotatable about its longitudinal axis. The grinding of the entire point of the valve needle 27 from the cylindrical section 43 to the peg 45 can be effected in a single machining step. In contrast to the known machining techniques for fuel injection valves, no burrs remain, the removal of which frequently results in deformations and damage to the contour of the sealing seat.

A very good correlation between valve needle stroke and fuel volume flowing off due to the rounding 90 is of particular advantage in the fuel injection valve described. Due to the comparatively small radius of the rounding 90 which leads to a distinctly linear contact between the valve needle 27 and the conical valve seat face 48, the tendency of the valve needle 27 to hydraulic "sticking" at the valve seat face 48 is far less than, for example, in injection valves which have spherical closing parts with their more planar sealing seat.

The fuel injection valve operates as follows:

When current flows through the magnetic coil 3, the armature 14 is pulled in the direction of the base nipple 7. The sealing seat 47 of the valve needle 27 firmly connected to the armature 14 is lifted away from the conical valve seat face 48, a flow cross-section is formed between the sealing seat 47 and the conical valve seat face 48, the fuel can reach the holes 80 through the annular space located between the nozzle body opening 49 the and peg 45. Fuel flows through the holes 80 with a high pressure drop since these holes form the narrowest flow cross-section within the fuel injection valve. Thus, the size of the holes 80 decides the volume flow of the ejected fuel, called "metering" by those skilled in the art. The fuel jet emerging from the holes 80 is directed towards the processing hole 70 in such a manner that it impinges barely upstream or directly on the processing edge 71. At the same time the speed of impingement is large enough to be called "impacting". Due to the high kinetic energy during the impingement onto the processing hole 70, the individual fuel droplets are torn apart and atomized. The consequence is that a fuel mist leaves the fuel injection valve downstream of the processing edge 71. This fuel mist allows good mixing with the intake air of the internal-combustion engine.

The annular groove 73 surrounding the processing edge 71 offers the advantage that fuel particles which may have become deposited on the inner wall 74 of the annular groove 73 are entrained, by a secondary eddy within the annular groove 73, towards the processing edge 71 and are also ejected there. Fuel injection valves having the annular groove 73 constructed in accordance with the invention show much less tendency towards drop formation than fuel injection valves without the annular groove 73. The causes determining this effect are still largely unexplained.

The fuel injection valve according to the invention achieves very good fuel processing. The best results are achieved with a thickness of the platelet 55 of 0.3 mm when the diameter of the processing hole 70 is 2.2 mm and the length 5 mm. The diameter of the holes 80 depends on the respective application and is within the range between 0.15 and 0.35 mm.

We claim:

1. A fuel injection valve for use in fuel injection systems of internal combustion engine, said fuel injection valve comprising:

a housing;

a nozzle body located in said housing and having a valve seat and an opening located downstream of said valve seat;

a valve needle located in said housing and cooperating with said valve seat for defining a flow area therebetween, said valve needle having a peg at an end thereof, said peg extending into said downstream opening of said nozzle body and defining therewith an annular space;

a processing sleeve connected with said housing and having a processing opening defining an edge; and a platelet located between said nozzle body and said processing sleeve, extending transverse to said downstream opening of said nozzle body and having a plurality of bores extending therethrough, said bores having an inlet facing said annular space.

2. A fuel injection valve according to claim 1, wherein an end surface of said peg is located adjacent to said platelet in a closed position of said valve.

3. A fuel injection valve for use in fuel injection systems of internal combustion engine, said fuel injection valve comprising:

a housing made of a ferromagnetic material;

a magnet coil located in said housing;

a nozzle body located in said housing and having a valve seat and an opening located downstream of said valve seat;

a valve needle located in said housing and cooperating with said valve seat for defining a flow area therebetween, said valve needle having a peg at an end thereof, said peg extending into said downstream opening of said nozzle body and defining therewith an annular space;

an armature located in said housing and fixedly connected with said valve needle for moving said valve needle relative to said seat;

a processing sleeve connected with said housing and having a processing opening defining an edge; and a platelet located between said nozzle body and said processing sleeve, extending transverse to said downstream opening of said nozzle body and having a plurality of bores extending therethrough, said bores having an inlet facing said annular space.

4. A fuel injection valve for use in fuel injection systems of internal combustion engine, said fuel injection valve comprising:

a housing;

a nozzle body located in said housing and having a valve seat and an opening located downstream of said valve seat;

a valve needle located in said housing and cooperating with said valve seat for defining a flow area therebetween, said valve needle having a peg at an end thereof, said peg defining with said downstream opening of said nozzle body an annular space;

a processing sleeve connected with said housing and having a processing opening defining an edge; and a platelet located between said nozzle body and said processing sleeve, extending transverse to said downstream opening of said nozzle body and having a plurality of bores extending therethrough, said bores having an inlet facing said annular space;

said valve needle having a conical portion located upstream of said peg and a first transient surface between said conical portion and said peg, said transient surface being rounded.

5. A fuel injection valve for use in fuel injection systems of internal combustion engine, said fuel injection valve comprising:

a housing;

a nozzle body located in said housing and having a valve seat and an opening located downstream of said valve seat;

a valve needle located in said housing and cooperating with said valve seat for defining a flow area therebetween, said valve needle having a peg at an end thereof, said peg defining with said downstream opening of said nozzle body an annular space;

a processing sleeve connected with said housing and having a processing opening defining an edge; and a platelet located between said nozzle body and said processing sleeve, extending transverse to said downstream opening of said nozzle body and having a plurality of bores extending therethrough, said bores having an inlet facing said annular space, said bores of said platelet having central axes intersecting a surface defining said processing opening at said edge.

6. A fuel injection valve for use in fuel injection systems of internal combustion engine, said fuel injection valve comprising:

a housing;

a nozzle body located in said housing and having a valve seat and an opening located downstream of said valve seat;

a valve needle located in said housing and cooperating with said valve seat for defining a flow area therebetween, said valve needle having a peg at an end thereof, said peg defining with said downstream opening of said nozzle body an annular space;

a processing sleeve connected with said housing and having a processing opening defining an edge; and a platelet located between said nozzle body and said processing sleeve, extending transverse to said downstream opening of said nozzle body and having a plurality of bores extending therethrough, said bores having an inlet facing said annular space, said nozzle body having an outer conical surface and said platelet has an end portion which rests against said conical surface.

7. A fuel injection valve according to claim 6, wherein said processing sleeve has an inner thread portion and said nozzle body has an outer thread portion at least partially received within said inner thread portion of said processing sleeve, said processing sleeve having a portion wedged against said nozzle body.

* * * * *